United States Patent [19]

Fujita

[11] 3,946,550

[45] Mar. 30, 1976

[54] QUARTZ CRYSTAL TIMEPIECE

[75] Inventor: Kinji Fujita, Shimosuwa, Japan

[73] Assignee: Kabushiki Kaisha Suwa Seikosha, Tokyo, Japan

[22] Filed: Apr. 19, 1974

[21] Appl. No.: 462,553

Related U.S. Application Data

[62] Division of Ser. No. 223,666, Feb. 4, 1972, Pat. No. 3,828,547.

[30] Foreign Application Priority Data

Feb. 18, 1971 Japan ..... 46-7161

[52] U.S. Cl. ..... 58/50 R; 58/23 BA

[51] Int. Cl.[2] ..... G04B 19/30; G04C 3/00

[58] Field of Search ..... 58/23 BA, 50 R; 307/38; 340/336; 350/160 LC

[56] References Cited

UNITED STATES PATENTS

| | | | |
|---|---|---|---|
| 3,715,881 | 2/1973 | Girard | 58/50 R |
| 3,750,383 | 8/1973 | Kakizawa | 58/50 R |
| 3,782,103 | 1/1974 | Saito | 58/23 BA X |
| 3,794,990 | 2/1974 | Kishimoto | 58/50 R |

*Primary Examiner*—Edith Simmons Jackmon

*Attorney, Agent, or Firm*—Blum, Moscovitz, Friedman & Kaplan

[57] ABSTRACT

A timepiece having a quartz crystal vibrator serving as a time standard, a liquid crystal display, and divider and driving circuits formed from COS/MOS transistors dividing the high frequency signal from the vibrator into low frequency timing signals for the direct driving of the liquid crystal display. The driving circuit includes a COS/MOS inverter directly coupled at its output to each liquid crystal display segment.

5 Claims, 11 Drawing Figures

QUARTZ CRYSTAL TIMEPIECE

This is a division, of application Ser. No. 223,666, which was filed Feb. 4, 1972 and is now U.S. Pat. No. 3,828,547.

BACKGROUND OF THE INVENTION

This invention relates to the construction of quartz crystal timepieces, and in particular, to quartz crystal wrist watches incorporating liquid crystal display means. It is essential to provide divider and driving circuitry which draws a minimum amount of power in order to maximize the life of the battery provided in such timepieces. Further, the batteries generally provided with quartz crystal timepieces provides voltages within the range of 1.2–3.5 volts while the liquid crystal displays generally require voltages of 10–30 volts. For this reason, means for stepping up the voltage of the battery in the timepiece must also be provided.

SUMMARY OF THE INVENTION

Generally speaking, in accordance with the invention, a timepiece is provided having a quartz crystal vibrator for producing a high frequency time standard signal, divider circuit means coupled to said quartz crystal vibrator for producing low frequency timing signals from said high frequency time standard signal, drive circuit means coupled intermediate said divider means and a liquid crystal display means for directly driving said liquid crystal display means. Both said divider circuit means and said driving circuit means are formed from COS/MOS transistors. Said timepiece may be provided with a battery coupled to said vibrator, divider and driving circuit means, and liquid crystal display means. A D.C. step-up transformer means may be provided intermediate said battery and said liquid crystal display means for increasing the voltage applied to said liquid crystal display means. All or a portion of said divider and driving circuit means may be powered from said step-up transformer means.

The driving circuit means includes a COS/MOS inverter directly connected to each of the liquid crystal display segments for directly driving said liquid crystal display segments.

Accordingly, the object of the invention is to provide a highly accurate electronic crystal wrist watch having no moving parts.

Another object of the invention is to provide a practical electronic wrist watch driven by only one or two conventional button-type cells.

A further object of the invention is to provide means for driving liquid crystal displays so as to provide high contrast and stability.

Still other objects and advantages of the invention will in part be obvious and will in part be apparent from the specification and drawings.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

FIG. *3a* is a circuit diagram of a COS/MOS inverter according to the invention;

FIG. *3b* is a timing chart depicting the waveforms of the inverter of FIG. *3a;*

FIG. *4a* is a circuit diagram of a binary divider formed from COS/MOS transistors;

FIG. *4b* is a timing chart depicting the input and output waveforms of the binary divider of FIG. *4a;*

Figure 5:
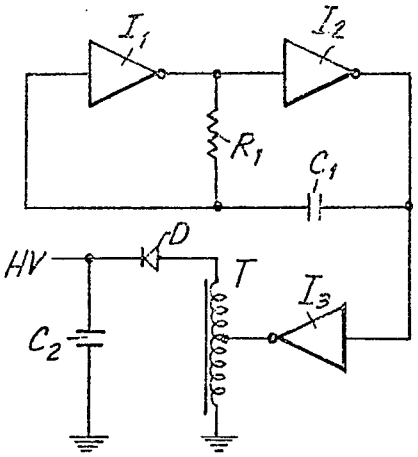
Figure 6:
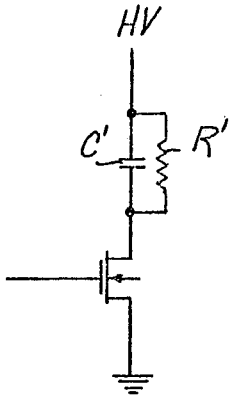
Figure 8:
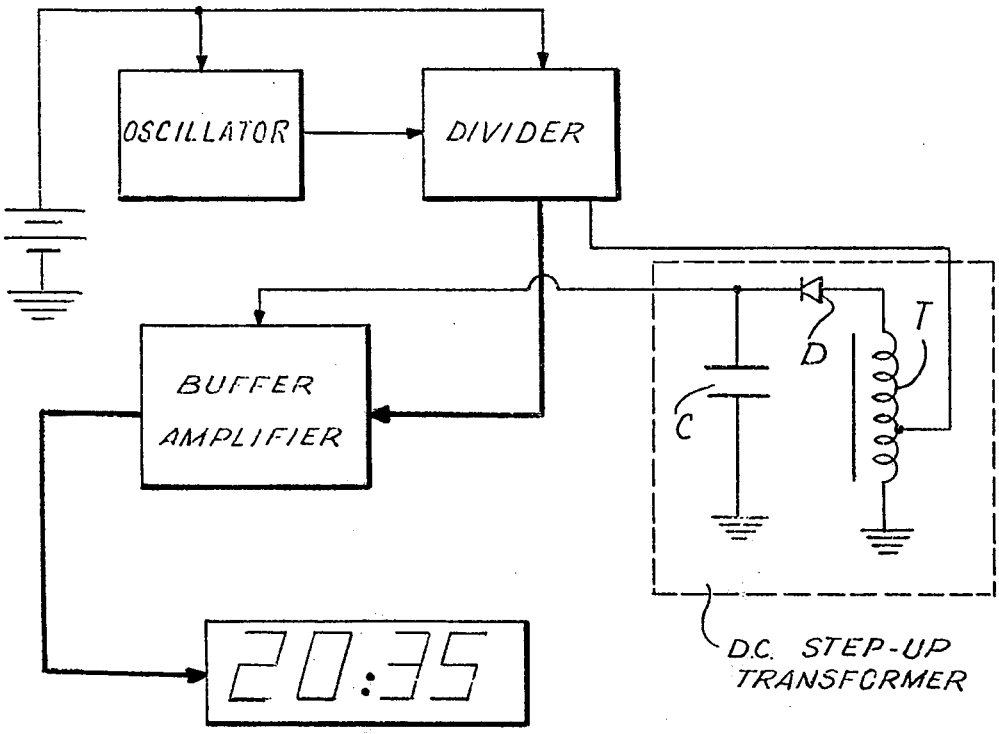

FIG. 5 is a circuit diagram of one embodiment of a D.C. step-up transformer in accordance with the invention;

FIG. 6 is a circuit diagram of one possible method for driving a liquid crystal display device;

FIG. *7a* depicts a circuit diagram of the preferred method of driving liquid crystal display devices in accordance with the invention;

FIG. *7b* depicts an array of liquid crystal display segments and the driving circuits therefor in accordance with the invention; and FIG. 8 is a block diagram of still another embodiment of the quartz crystal timepiece in accordance with the invention.

DESCRIPTION OF THE PREFERRED EMBODIMENTS

Figure 1:
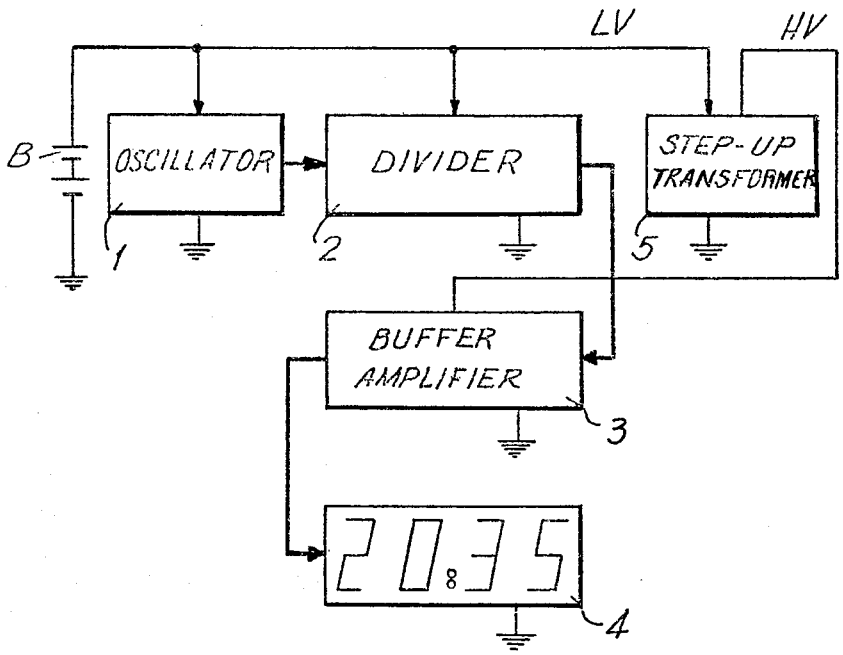
FIG. 1 is a block diagram of a first embodiment of the quartz crystal timepiece in accordance with the invention.

Referring now to FIG. 1, the quartz crystal timepiece depicted includes a pair of cells B such as would be used in conventional electronic wrist watches. Such cells could be of the mercury oxide, silver oxide, or Ni-Cd type. One or two of such cells are customarily incorporated in electric wrist watches, but more than two cells may be incorporated in special wrist watches. The cells B supply a low voltage of between 1.2 and 3.5 volts to oscillator 1, divider means 2 and step-up transformer means 5 through line LV.

Oscillator 1 consists of a quartz crystal vibrator adapted to produce a high frequency time standard signal. Divider circuit 2 includes a binary divider chain for dividing the high frequency time standard signal into low frequency timing signals such as a 1-second signal or a 1-minute signal. In the embodiment of FIG. 1, where seconds are not displayed, it would be sufficient for the binary divider chain to reduce the high frequency signal to a 1-minute signal. Said 1-minute signal is applied to a series of dividers within divider circuit 2 for producing 10-minute, 1-hour and 24-hour signals. The liquid crystal display panel 4 provides a digital display of the hour and minute by means of a segmented array of liquid crystal display segments. For example, each digit of the digital display may consist of a seven bar display array, each number from 0 to 9 being displayed by various combinations of the seven bars. Divider circuit 2 also includes decoder circuits producing suitable display driving signals for driving the appropriate combinations of liquid crystal display segments in response to each 1-minute, 10-minute and 1-hour signals.

The operative signals are transmitted in the circuit of FIG. 1 along the path defined by the heavy line from oscillator 1, to divider circuit 2, to buffer amplifier 3 for amplifying the decoded signals for application to the associated liquid crystal display segments of liquid crystal display means 4. The high voltage of 10–30 volts required for driving the liquid crystal display device 4 is supplied to the buffer amplifiers 3 through a step-up transformer 5 along line HV. By providing the D.C. step-up transformer, it is unnecessary to incorporate special cells having higher voltages.

In the embodiment of the circuit in accordance with the invention of FIG. 2, the operative circuits function in the manner described in connection with like circuits of FIG. 1, but step-up transformer 5 is connected directly to the battery, and the power to each of oscillator 1, divider circuit 2, and buffer amplifier 3 is provided from the high voltage output of the D.C. step-up transformer.

Figure 3A:
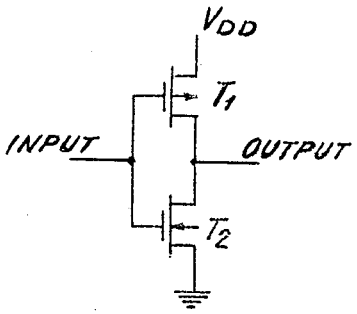
Figure 3B:
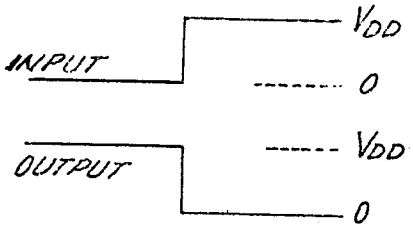

Referring now to FIG. 3, an inverter forming a fundamental unit of COS/MOS (metal oxide semiconductor transistors disposed in the complimentary symmetry configuration) integrated circuits. The inverter of FIG. 3*a* is formed from a P channel MOS transistor $T_1$ of the enhancement type and a N channel MOS transistor $T_2$ of the enhancement type. The source-drain paths of said two transistors are connected in series between power source $V_{DD}$ and ground. In the stabilized state, the COS/MOS inverter of FIG. 3*a* consumes only leakage current. For this reason, COS/MOS integrated circuits formed from such inverters may form micropower circuits particularly effective for application in timepieces where power consumption must be very limited, such as wrist watches. A timing chart of the input voltage and the output voltage of the inverter of FIG. 3*a* is depicted in FIG. 3*b*. Said inverter consumes extremely small leakage current and has a charging loss equal to $\frac{1}{2} CV_{DD}^2 f$. Since the capacitance C is very small, and since the frequency of $f$ of a electric timepiece is relatively low, it is possible to substantially reduce the power consumption of the inverter circuit.

Figure 4A:
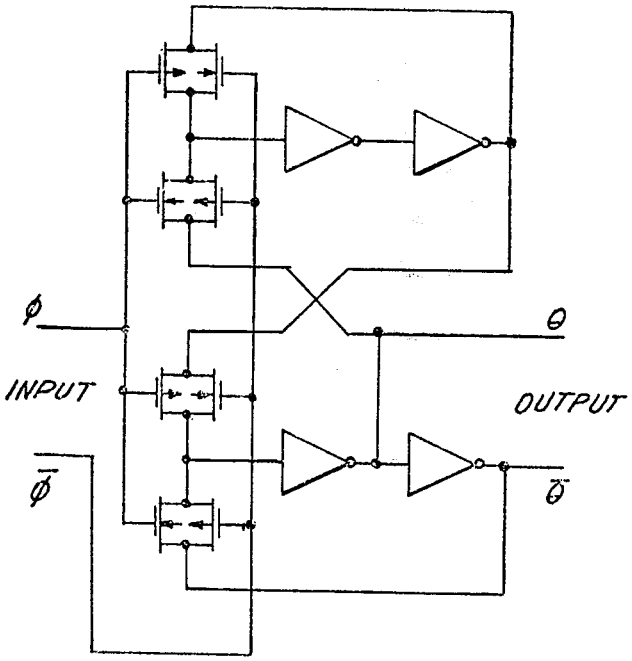
Figure 4B:
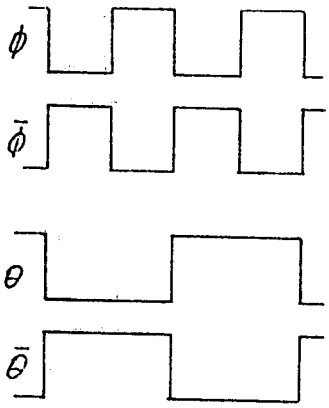

A master-slave type binary divider formed from COS/MOS integrated circuits is depicted in FIG. 4*a*, wherein each of the triangular symbols represents a COS/MOS inverter. The divider circuit 2 of FIGS. 1 and 2 would be formed from a chain of such binary divider circuits, wherein the output Q and $\overline{Q}$ define the inputs $\phi$ and $\overline{\phi}$ of the next stage of the binary divider chain. A timing chart of the input and output voltages of the binary divider of FIG. 4*a* is depicted in FIG. 4*b*, from which it is apparent that each such binary divider circuit produces an output signal of a frequency equal to ½ the frequency of the input signal applied thereto. The frequency divider circuit of FIG. 4*a* is particularly advantageous when applied to timepieces such as watches, since said circuit consumes only several nW in normal operation.

Figure 2:
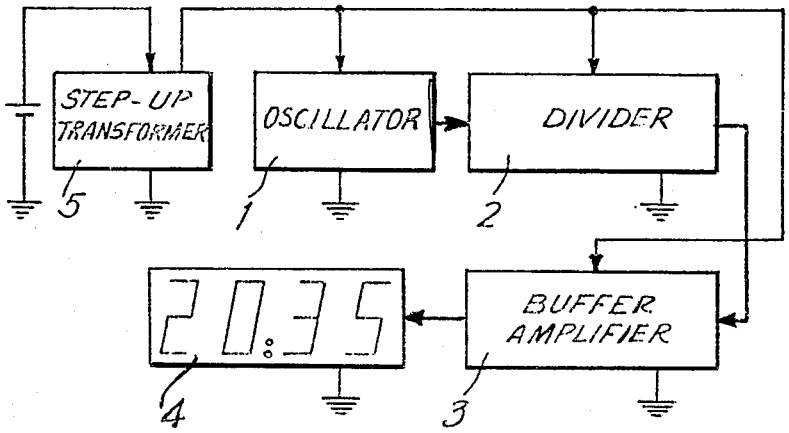
FIG. 2 is a block diagram of a second embodiment of the quartz crystal timepiece in accordance with the invention.

Referring now to FIG. 5, a D.C. step-up transformer corresponding to the transformer 5 of the embodiments of FIGS. 1 and 2 is depicted. Said transformer consists of a series loop formed from inverters $I_1$ and $I_2$ and a capacitor $C_1$. A resistor $R_1$ is connected in parallel with inverter $I_1$, said circuit defining an astable multivibrator. The output of said multivibrator is amplified by the inverter $I_3$ for application to the center tap of a step-up transformer winding T. The output pulse voltage of transformer winding T is rectified by diode D and filtered by capacitor $C_2$ to produce a D.C. voltage of a value higher than the input voltage applied to inverter $I_3$ by an amount determined by the turns ratio of transformer winding T. The output signal of the oscillator or of a divider stage could be utilized as depicted in FIG. 8, as the input signal to transformer winding T in place of the output signal of the multivibrator if desired.

FIG. 6 shows one possible driving method for liquid crystal display devices wherein an enhancement type MOS transistor is connected with its source-drain path connected in series with a liquid crystal display segment represented by the equivalent circuit thereof. Said equivalent circuit consists of the parallel combination of capacitor C′ and a resistor R′. Said series connection is connected between a source of voltage HV (the high driving voltage output from a step-up transformer) and ground. The arrangement of FIG. 6 has proved difficult to precisely switch on and off. This results from the fact that the liquid crystal display segments incorporated in electric timepieces have extremely high impedance (for example, R $\gtrsim$ 500 M ohms) and the MOS transistor permits little leakage current.

Figure 7A:
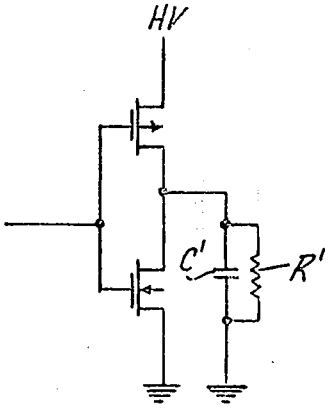

On the other hand, the driving method depicted in FIG. 7*a* avoids these defects through utilization of the characteristics of COS/MOS integrated circuits. Said arrangement consists of connecting said liquid crystal display segments between the output of a COS/MOS inverter and ground. The output impedance of a COS/MOS inverter is low at all times, since one MOS transistor is on, and the other is off at all times. Further, the power consumption of the COS/MOS inverter is extremely low. For this reason, the leakage current required for switching each driving MOS transistor on and off is not as critical, while on the whole, if the power consumption of the COS/MOS integrated circuit is limited, such leakage current may be sufficient. The arrangement of FIG. 7*a* permits the switching of high impedance liquid crystal display segments and insures a clear contrast in said display segments.

Figure 7B:
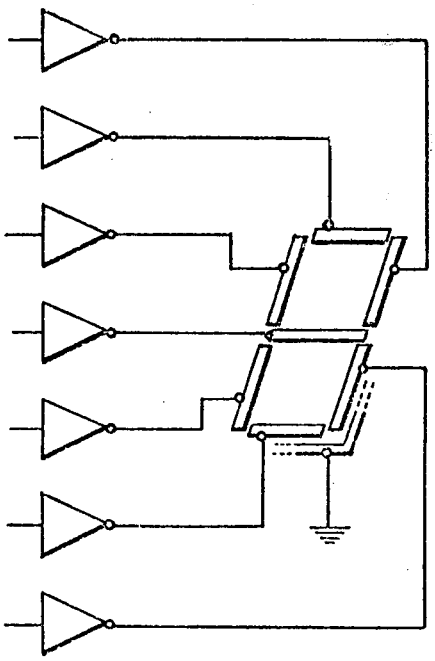

A seven bar segmented display formed from liquid crystal display segments is depicted in FIG. 7*b*. The liquid crystal device would consist of a pair of plates, the seven segmented bars being deposited as electrodes on the inner surface of one of said plates while a common electrode is deposited on the inner surface of the other of said plates. Liquid crystal material would be retained in the space between said plates. In the embodiment of FIG. 7*b*, at least the upper plate bearing the segmented electrodes and said segmented electrodes would be formed of transparent material. The common electrode is connected to ground, while each of the seven segments are connected to the output of a COS/MOS inverter. When a signal is applied to a particular inverter, the region of the liquid crystal material intermediate the segment associated therewith and the common electrode is rendered visible by the action of the applied voltage on the liquid crystal material to provide a visible display. The high voltage is applied to the seven driving inverters, the segmented electrodes being connected directly to the output terminals of their respective inverters.

The arrangement according to the invention as described above provides an electronic step-up voltage transformer permitting the use of the conventional low-voltage cells in electric timepieces and further providing a COS/MOS direct driving circuit for liquid crystal display segments which permit certain switching of the high impedance liquid crystal elements. These features contribute to the provision of a practical and highly reliable quartz crystal watch unavailable from conventional watch constructions.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A timepiece comprising timekeeping circuit means for producing low frequency timing signals in response to a high frequency time standard signal; liquid crystal display means for the digital display of time; driving circuit means intermediate said time keeping circuit means and said liquid crystal display means for producing driving signals in response to said timing signals for driving said liquid crystal display means; battery voltage source means for producing a low voltage for powering said timekeeping circuit means; and D.C. step-up transformer means for producing a high voltage from a low voltage for application to said driving circuit means as a power signal, said D.C. step-up transformer means having an input supplied with an oscillatory low voltage signal by said timekeeping circuit means, whereby said driving signals are of a high voltage.

2. A timepiece is recited in claim 1, wherein said timekeeping circuit means includes a quartz crystal vibrator means for producing a high frequency time standard signal and divider circuit means for producing the said timing signals from said time standard signals, said divider circuit means and driving circuit means both being formed of COS/MOS integrated circuits.

3. A timepiece as recited in claim 1, wherein said D.C. step-up transformer means includes transformer winding means having a high voltage output and a low voltage input, and rectifier means connected to said high voltage output for producing said D.C. high voltage.

4. A timepiece as recited in claim 1, wherein said driving circuit means includes COS/MOS inverter means having outputs directly connected to said liquid crystal display means for driving said liquid crystal display means.

5. A timepiece as recited in claim 4, wherein said liquid crystal display means includes a plurality of segmented digital arrays, one of said COS/MOS inverters being associated with each segment of each array for application of a driving signal thereto.

* * * * *